US005649388A

United States Patent [19]

Best et al.

[11] Patent Number: 5,649,388

[45] Date of Patent: Jul. 22, 1997

[54] APPARATUS FOR MOUNTING A SASH IN A FRAME

[75] Inventors: Martin Clive Best, Yeovil; Stephen Clive Tomlinson, Crewrerne, both of Great Britain

[73] Assignee: Caradon Catnic Limited, Glamorgan, United Kingdom

[21] Appl. No.: 508,591

[22] Filed: Jul. 28, 1995

[30] Foreign Application Priority Data

Aug. 5, 1994 [GB] United Kingdom ..... 9415824

[51] Int. Cl.[6] ..... E05D 15/22

[52] U.S. Cl. ..... 49/181; 52/204.51

[58] Field of Search ..... 52/209.51, 207; 49/181

[56] References Cited

U.S. PATENT DOCUMENTS

| | | | |
|---|---|---|---|
| 3,842,540 | 10/1974 | Anderson . | |
| 3,844,066 | 10/1974 | Nobes | 49/181 |
| 4,079,549 | 3/1978 | Wood . | |
| 4,227,345 | 10/1980 | Durham, Jr. | 49/181 |
| 4,682,455 | 7/1987 | Klompenburg | 52/207 X |
| 4,914,861 | 4/1990 | May . | |
| 4,944,118 | 7/1990 | Biro | 52/207 X |
| 5,069,001 | 12/1991 | Makarowski . | |
| 5,127,192 | 7/1992 | Cross | 49/181 |
| 5,168,665 | 12/1992 | Goldenberg | 49/181 X |
| 5,383,303 | 1/1995 | Nakanishi et al. | 49/181 |
| 5,414,960 | 5/1995 | O'Donnell et al. | 49/181 X |

FOREIGN PATENT DOCUMENTS

| | | |
|---|---|---|
| 1 500 601 | 1/1975 | United Kingdom . |
| 2 236 786 | 4/1991 | United Kingdom . |
| 2 247 907 | 3/1992 | United Kingdom . |
| 2 262 123 | 6/1993 | United Kingdom . |
| 2 276 655 | 10/1994 | United Kingdom . |
| 2 280 697 | 2/1995 | United Kingdom . |

*Primary Examiner*—Carl D. Friedman
*Assistant Examiner*—Creighton Smith
*Attorney, Agent, or Firm*—Pearne, Gordon, McCoy & Granger LLP

[57] ABSTRACT

The invention relates to a slidable, tiltable sash and to apparatus for providing sliding and tilting thereof comprising a slidable body means, stop means and pivot means, operatively connected with the sash whereby on pivoting of the sash the pivot means is turned to bring a locking surface thereof into frictional engagement with the stop means to prevent sliding of the sash during pivotal movement of the sash.

13 Claims, 5 Drawing Sheets

APPARATUS FOR MOUNTING A SASH IN A FRAME

The invention relates to apparatus for mounting a sash in a frame, to a frame assembly comprising such apparatus, to a kit of parts for providing a mounting for a sash in a frame, and to a method of providing a sash window. More particularly, the invention relates to apparatus adapted to enable a slidable sash window to be safely tilted out of the plane of the frame.

In the past a variety of different apparatus has been provided in order to enable sash windows which open and close by substantially vertical sliding, to be tilted out of the plane of their frames. Such tilting is desirable as it enables the outer surface of the window to be cleaned and essential maintenance such as painting to be carried out from the inside. Examples of such apparatus include systems employing a tilt shoe or block which frictionally restrains the bottom pivoting rail of the sash when tilted inwards. However unreliability and inconsistency of the tilt shoe retention due to variation in friction surfaces has been found to render such systems potentially dangerous.

One example of apparatus of this kind is described in Applicant's United Kingdom Patent No. 2 217 372B, which apparatus consists of a sliding mount fixable to the frame of a window, the mount having a pivot to allow balanced tilting of the sash, and a stay located in the sliding mount, to limit the pivotal movement of the sash.

It has now been found that a simpler, more economical apparatus is required which is easier to install, and is capable of fitting into existing frame sections for use in existing windows.

It is an object of the invention to seek to address matters such as these.

According to a first embodiment of the invention, there is provided apparatus for mounting a sash in a frame, comprising slider means adapted to support the sash slidably in the frame, and pivot means adapted to enable the sash to pivot out of the plane of the frame, the pivot means being adapted to engage with stop means of the apparatus to restrict sliding of the sash on pivotal movement.

The stop means may be adapted to restrict sliding of the sash when the sash pivots out of the plane of the frame.

The pivot means may comprise a rotatable member, and may include a cam surface. It may also comprise an aperture adapted to receive an operating member of the sash.

It is preferred that the pivot means is disposed in an aperture of the slider means.

The stop means may comprise an elongate member, which may have a locking surface. The locking surface may include gripping means, which may comprise a plurality of serrations. The stop means may comprise a plurality of locking surfaces.

It is preferred that the slider means is adapted to receive the pivot means and the stop means in operative proximity, and that the slider means is adapted to slidably receive the stop means in an aperture thereof.

The sash may comprise an operating member which is preferably adapted to be operatively connected to the pivot means.

The operating member may be a part of an elongate member affixed to the sash.

According to a second embodiment of the invention, there is provided a window frame assembly comprising apparatus as hereinbefore defined.

According to a third embodiment of the invention there is provided a kit of parts for providing a mounting for a sash in a frame, comprising apparatus as hereinbefore defined.

According to a fourth embodiment of the invention there is provided a method of providing a sash window, comprising mounting a sash in a frame using apparatus as hereinbefore defined.

Apparatus embodying the invention is hereinafter described, by way of example, with reference to the accompanying drawings.

Figure 1:
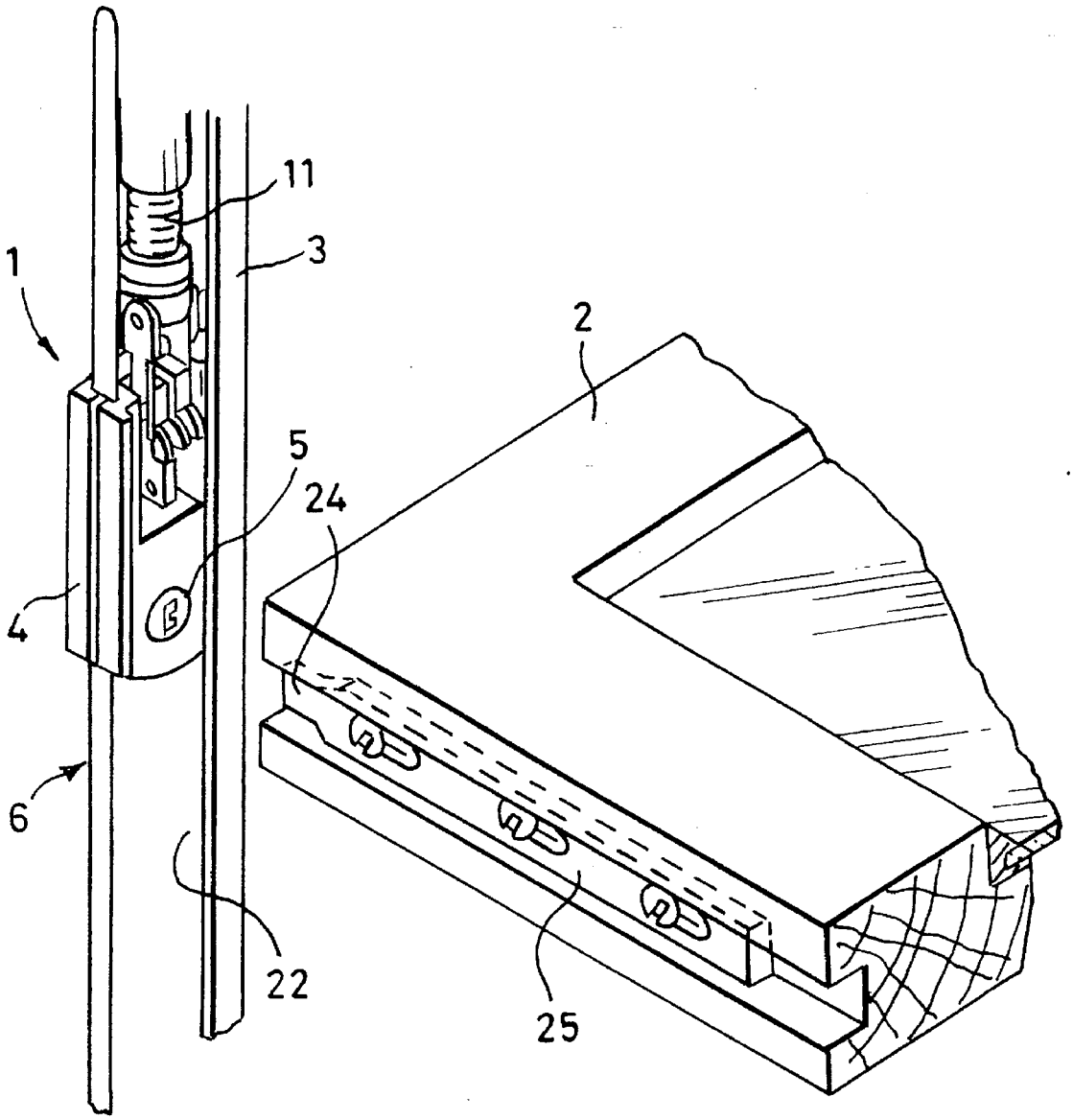
FIG. 1 is a fragmentary perspective view of a window assembly including apparatus according to an embodiment of the invention.
Figure 2:
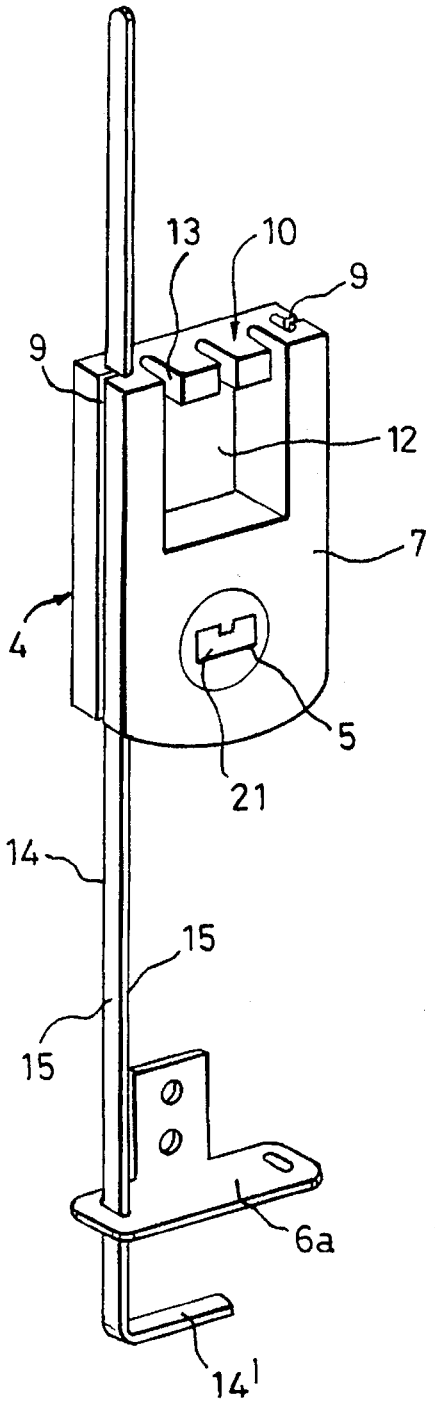
FIG. 2 is a perspective view of an embodiment of apparatus according to the invention.

Referring to the drawings, there is illustrated apparatus 1 for mounting a sash 2 in a frame 3, comprising slider means 4 adapted to support the sash 2 slidably in the frame 3, and pivot means 5 adapted to enable the sash 2 to pivot out of the plane of the frame 3, the pivot means 5 being adapted to engage with stop means 6 of the apparatus to restrict sliding of the sash 2.

Figure 12:
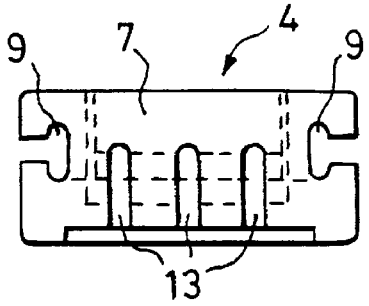
FIG. 12 is a plan view of the slider means of FIG. 9.

From FIGS. 2 and 8 to 11, it can be seen that the slider means 4 consists of a substantially rectangular body 7, which may be formed from any suitable material such as for example a metal or plastic, and which may be formed by any suitable method such as moulding. The body 7 is provided with a circular recess 8 wherein the pivot means 5 is mounted. On each longitudinal edge, the body 7 is provided with a channel 9 which communicates via aperture 18 with the recess 8 and which in the embodiment has a T-shape when viewed in plan (see FIG. 12). The body 7 is further provided with means 10 to enable it to be attached to the balance 11 of the sash 2 operating mechanism (not shown). The means 10 comprises a square cut-away 12 extending into the body 7 and which communicates with the upper (in use) end of the slider means 4 via three U-shaped cut-aways 13.

Figure 3:
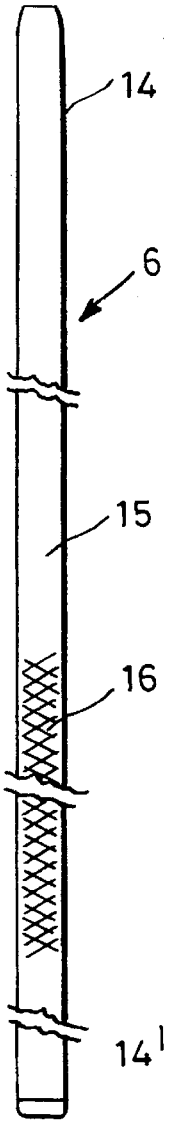
FIGS. 3 and 4 are front and side views respectively of stop means for use in the apparatus of FIG. 2.
Figure 4:
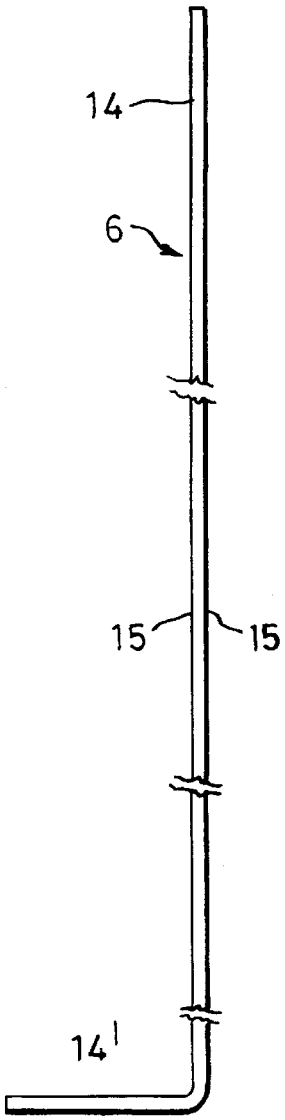
Figure 5:
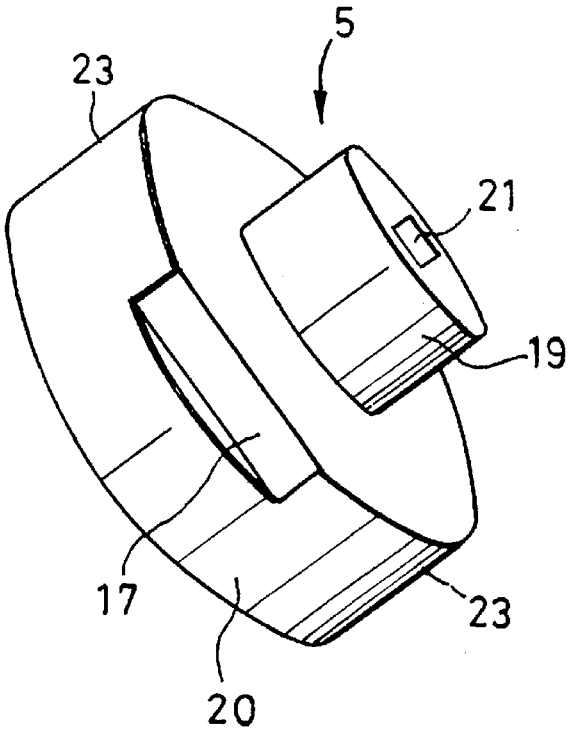
FIG. 5 is a perspective view of pivot means for use in the apparatus of FIG. 2.
Figure 6:
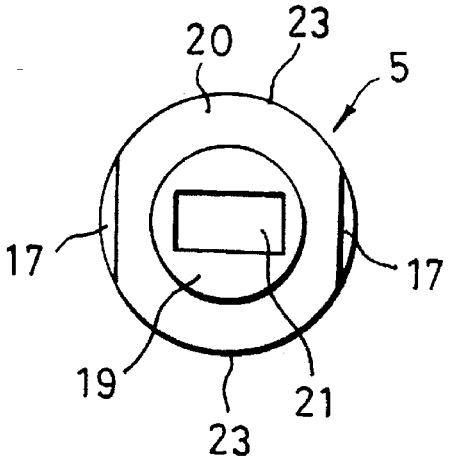
FIGS. 6, 7 and 8 are plan, side and transverse sectional views respectively of the pivot means of FIG. 5.
Figure 7:
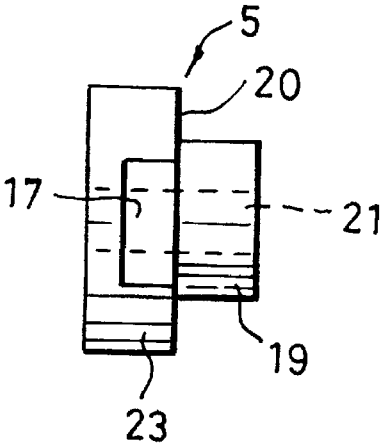
Figure 8:
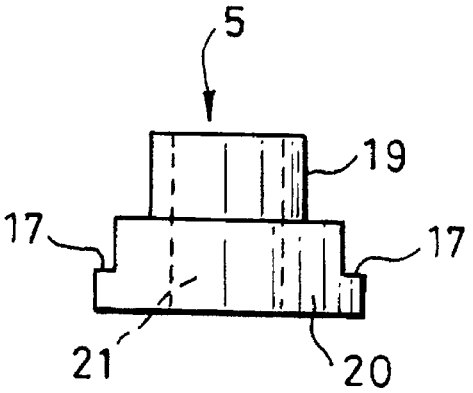
Figure 9:
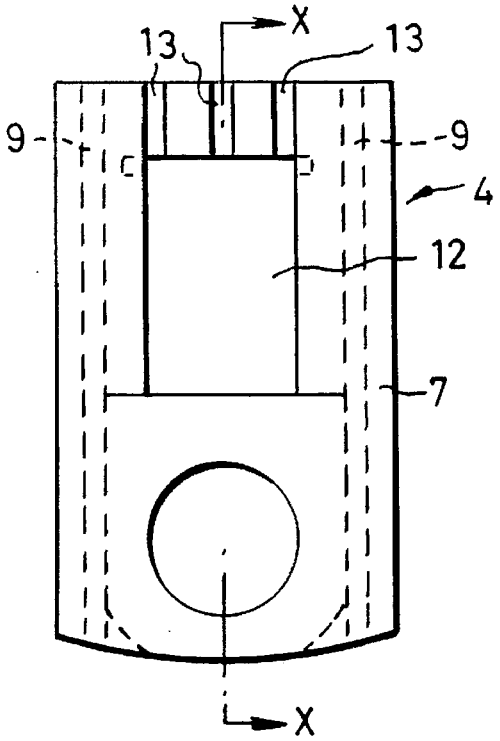
FIGS. 9 and 10 are front and rear views respectively of slider means for use in the apparatus of FIG. 2.
Figure 10:
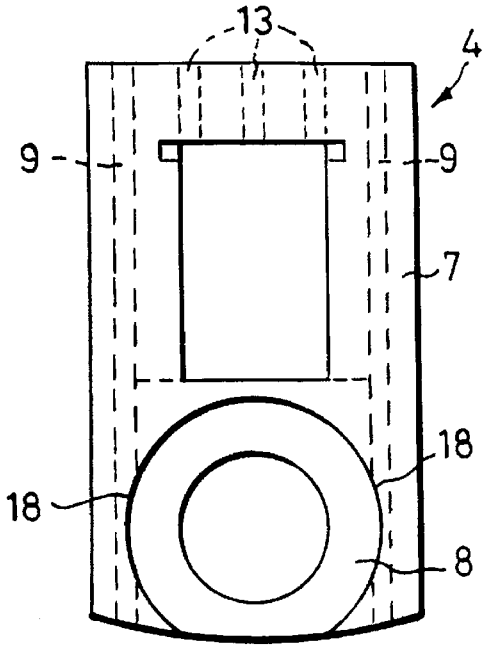
Figure 11:
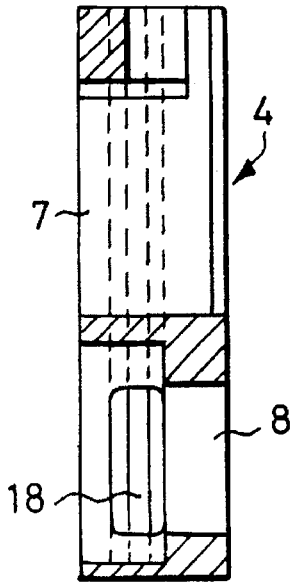
FIG. 11 is a sectional view along lines 11—11 of FIG. 9.

As illustrated in FIGS. 3 and 4, the stop means 6 consists of an elongate member 14, having two locking surfaces 15. One or each locking surface 15 may be provided with gripping means in the form of knurls or serrations 16. One end of the member 14 is curved around at an angle of about 90° to form an L-shape, the shorter arm 14' being received in a groove of the window frame (FIG. 13) for anchoring of the stop means. There may be provided a bracket **6*a* (FIG. 2) for fixing the stop means 6 to the frame 3**.

The pivot means 5 is shown particularly in FIGS. 2 and 5 to 7, and consists of a body having a substantially circular part 20 with opposing flats or cut-aways 17, which extend a short distance towards its centre, and to about a half to two-thirds of its depth. The effect of this is to reduce the diameter of the part 20 at this point leaving curved or cam surfaces 23 at the original diameter of the part 20. The body also includes projecting from the part 20, a further part in the form of a projection or stem 19 of similar depth, but about two thirds the diameter of, the part 20. A bore of rectangular shape 21 is provided which extends through both parts 19, 20 from one end to the other.

As will be appreciated, in use in a sash window it is usual practice to use two sets of apparatus 1, one on either side of the frame 3. For the purposes of convenience only one such apparatus 1 is described herein.

In use, the slider means 4 or tilt shoe is attached to the balance 11 of the sash 2 as shown in FIG. 1. The slider means 4 is received in a groove 22 of the frame 3, and is positioned with the elongate member 14 of the stop means 6 extending through the channel 9 of the body 7. The elongate member 14 is received in the channel 9 with one of its locking surfaces 15 positioned towards the recess 8. The pivot means 5 or cam balance tilt block is received in the recess 8, with the part 19 inner-most (in use), such that the surfaces 23 and cut-aways 17, are positioned directly adjacent the aperture 18 which communicates the recess 8 with the channel 9, and with the elongate member 14 received in the cut away 17 so that the major surface of the elongate member 14 is substantially parallel to the flat surface of the cut-away 17. The diameter of part 20 is dimensioned such that when surface 23 is moved adjacent the aperture 18 by rotation of the pivot means 5, it contacts the locking surface 15 of the elongate member 14, by way of a camming action, preventing further rotation of the pivot means 5 in that direction. This also has the effect of preventing sliding movement of the slider means.

The sash 2 is connected with the apparatus 1 via an operating member 24 which extends from a pivot bar 25 fixed to the bottom surface (in use) of the frame 3. The operating member 24 is profiled and dimensioned to fit snugly within the bore 21 of the pivot means 5.

In normal vertical operation the stop means 6 does not interfere with the pivot means 5 because the flat surface of the cut-away 17 slides past the major surface of the elongate member 14 of the stop means 6, and thus the sash 2 is free to slide easily. When, however, access to the outside of the window is required, the sash 2 is first released by bolts, for example in the top edge (not shown) and the sash 2 is swung inwards, pivoting on the pivot means 5 via the operating member 24 and the pivot bar 25.

As the sash 2 rotates the pivot means 5, a cam surface 23 of the part 20 is brought into contact with the locking surface 15 of the stop means 6, applying pressure thereto and forcing it against the face of the channel 9 whereby to prevent by gripping and friction sliding of the sash and to grip the sash so that it cannot slide. Access is thus gained to the outside of the window.

Figure 13:
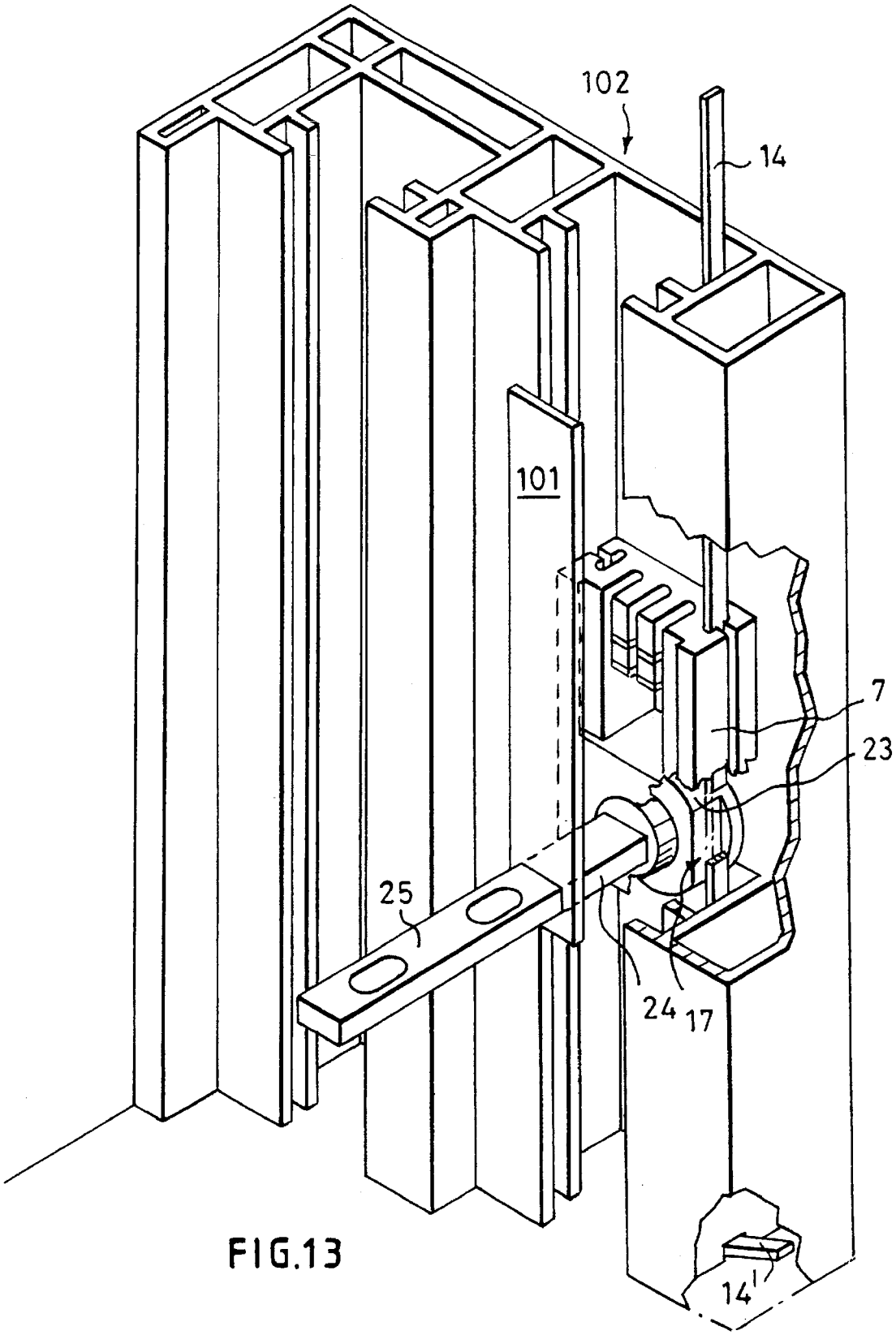
FIG. 13 is a partly broken away isometric view of apparatus according to the invention in position in a window and frame.

Referring now to FIG. 13, the apparatus 100 shown is virtually identical to that of FIGS. 1 to 12, so the same numerals are used to indicate like parts, the only real difference being in the configuration of the body 7, which however does not affect the invention or the way the apparatus works. The slidable/tiltable sash is indicated at 101, the window frame comprising a profile 102, suitably of plastic.

Thus it can be seen that the invention allows sash windows to be fitted safely and easily for cleaning and maintenance, whilst being compact enough to fit into existing window assemblies, and simple to manufacture.

In all embodiments the two channels 9 allow for left and right hand mounting of the body 7.

We claim:

1. Apparatus for mounting a sash in a frame, comprising:

(i) slider means adapted to support the sash slidably in said frame;

(ii) pivot means carried by said slider means adapted to be connected to the sash to slidingly guide said sash in said frame and to enable the sash to pivot out of a place of said frame;

(iii) stop means comprising an elongate strip of relatively rigid material adapted to be fixed to said frame to restrict sliding of the sash and having a locking surface which includes gripping means;

(iv) the pivot means engage with said stop means of the frame and being adapted to restrict sliding of the sash during pivotal movement.

2. Apparatus as defined in claim 1, wherein the pivot means comprises a rotatable member.

3. Apparatus as defined in claim 2, wherein the rotatable member comprises a cam surface.

4. Apparatus as defined in claim 1, wherein the pivot means comprises an aperture adapted to receive an operating member of the sash.

5. Apparatus as defined in claim 1, wherein the slider means defines an aperture and wherein the pivot means is mounted in said aperture of the slider means.

6. Apparatus as defined in claim 1, wherein the gripping means comprises a plurality of serrations.

7. Apparatus as defined in claim 1, wherein the slider means is adapted to receive the pivot means and the stop means in operative proximity.

8. Apparatus as defined in claim 7, wherein the slider means defines an aperture in which the stop means is mounted.

9. Apparatus as defined in claim 1, wherein there is an operating member for attachment to the sash and adapted to be operatively connected to the pivot means.

10. Apparatus as defined in claim 9, wherein the operating member is a part of an elongate member affixed to the sash.

11. A frame assembly comprising apparatus as defined in claim 1.

12. A method of providing a sash window, comprising mounting a sash in a frame using apparatus as defined in claim 1.

13. Apparatus for mounting a sash in a frame, comprising:

(i) slider means adapted to support the sash slidably in said frame, (ii) pivot means carried by said slider means adapted to be connected to the sash to slidingly guide said sash in said frame and to enable the sash to pivot out of said frame;

(iii) stop means comprising an elongate strip of relatively rigid material adapted to be fixed to said frame to restrict sliding of the sash, said slider means receiving the pivot means and the stop means in operative proximity and defining an aperture in which said stop means is mounted;

(iv) the pivot means engage with said stop means being adapted to restrict sliding of the sash during pivotal movement.

* * * * *